US007555237B1

(12) United States Patent
Han et al.

(10) Patent No.: US 7,555,237 B1
(45) **Date of Patent: *Jun. 30, 2009**

(54) POSITIONING MECHANISM FOR POSITIONING A DEVELOPING APPARATUS AND RELATED DEVELOPING APPARATUS

(75) Inventors: Chin-Lung Han, Hsinchu (TW); Hung-Hsu Hsu, Hsinchu (TW)

(73) Assignee: Aetas Technology Incorporated, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/037,937

(22) Filed: Feb. 27, 2008

(51) Int. Cl.
*G03G 15/06* (2006.01)

(52) U.S. Cl. ..... 399/111; 399/119; 399/12; 399/13

(58) Field of Classification Search ..... 399/111, 399/119, 12, 13
See application file for complete search history.

(56) References Cited

U.S. PATENT DOCUMENTS

| | | | | |
|---|---|---|---|---|
| 6,647,233 | B2 * | 11/2003 | Hiroki | 399/228 |
| 2005/0111858 | A1 * | 5/2005 | Nakazato | 399/12 |
| 2006/0067725 | A1 * | 3/2006 | Miyabe et al. | 399/90 |
| 2006/0291899 | A1 * | 12/2006 | Preston et al. | 399/111 |

* cited by examiner

*Primary Examiner*—David M Gray
*Assistant Examiner*—G. M. Hyder
(74) *Attorney, Agent, or Firm*—Winston Hsu

(57) ABSTRACT

A positioning mechanism for positioning a developing apparatus is disclosed. The positioning mechanism includes a base. A guide slot is formed on the base for guiding the developing apparatus to slide inside the base in a first direction. The base includes a first end and a second end. The lock mechanism further includes a positioning roller disposed on a first side of the guide slot for pressing the developing apparatus when the developing apparatus is inserted inside the base completely so that a first end of the developing apparatus contacts against the first end of the base and a second end of the developing apparatus contacts against the second end of the base.

19 Claims, 5 Drawing Sheets

POSITIONING MECHANISM FOR POSITIONING A DEVELOPING APPARATUS AND RELATED DEVELOPING APPARATUS

BACKGROUND OF THE INVENTION

1. Field of the Invention

The present invention relates to a positioning mechanism, and more particularly, to a positioning mechanism for positioning a developing apparatus and the related developing apparatus.

2. Description of the Prior Art

Electrophotographic systems are generally employed in image-forming devices, the operation of which involves several steps: charging, exposing, developing, transferring, fusing, cleaning, and erasing. The color photoelectric image forming devices utilize toners of different colors to form color images. For example, a four-color photoelectric image-forming device utilizes a yellow toner cartridge, a magenta toner cartridge, a cyan toner cartridge, and a black toner cartridge to form color images.

Please refer to FIG. 1. FIG. 1 is a diagram of an image-forming device 10 in the prior art. The image-forming device 10 can be a laser printer, a multi-functional product, and so on. The image-forming device 10 includes a housing 12 for covering inner components of the image-forming device 10, a photoconductive belt 14, a charger 16, an exposing device 18, a developing device 20 including a plurality of developing apparatus, a clean device 22, a transfer roller 24, a fuser 26, and a discharge unit 28. When the image-forming device 10 prints an image, as the first step of the entire process, the charger 16 charges a surface of the photoconductive belt 14 to a charged potential. The exposing device 18 exposes the photoconductive belt 14 to form a latent image on the photoconductive belt 14. The toners stored in the plurality of developing apparatus are jumped onto the latent image to form a toner image. The transfer roller 24 transfers the toner image on a print medium 30, such as paper. At last, the fuser 26 fuses the toners on the print medium 30. The clean device 22 cleans the rest toners on the photoconductive belt 14, and the discharge unit 28 discharges the rest charged potential on the photoconductive belt 14.

The toners stored in the developing apparatus are provided for the laser printing device to print an image. The developing apparatus combines with the laser printing device with gate shut for positioning the developing apparatus in the prior art. It has a disadvantage of inaccurate position of the developing apparatus, and increase of the size and the component number of the laser printing device. There is a need to design a simple positioning mechanism for positioning the developing apparatus in the laser-printing device accurately.

SUMMARY OF THE INVENTION

It is therefore a primary objective of the invention to provide a positioning mechanism for positioning a developing apparatus and the related developing apparatus for solving the above-mentioned problem.

According to the claimed invention, a positioning mechanism for positioning a developing apparatus is disclosed. The positioning mechanism includes a base. A guide slot is formed on the base for guiding the developing apparatus to slide inside the base in a first direction. The base includes a first end and a second end. The positioning mechanism further includes a positioning roller disposed on a first side of the guide slot for pressing the developing apparatus when the developing apparatus is inserted inside the base completely so that a first end of the developing apparatus contacts against the first end of the base and a second end of the developing apparatus contacts against the second end of the base.

According to the claimed invention, a developing apparatus for installing inside a base of an image-forming device is disclosed. A guide slot is formed on the base. The developing apparatus includes a track for sliding inside the guide slot of the base wherein a notch is formed on the track for positioning a positioning component of the base.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
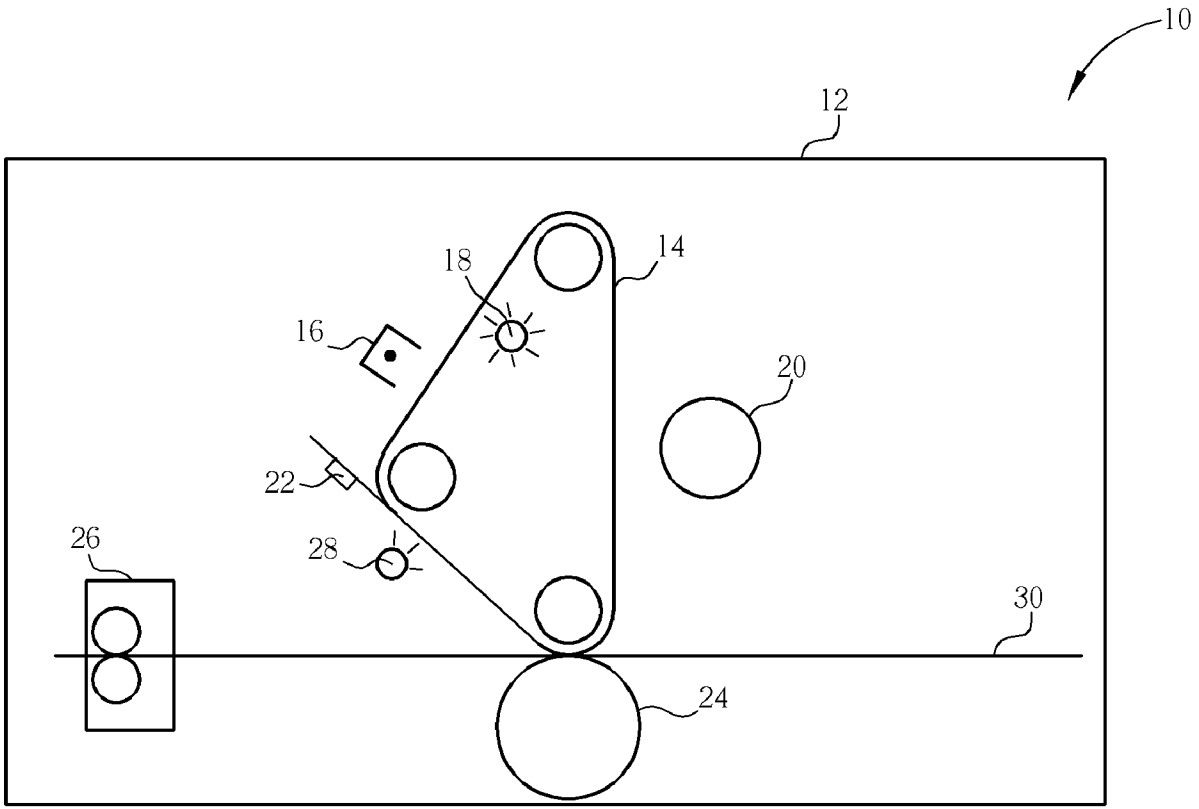
FIG. 1 PRIOR ART
FIG. 1 is a diagram of an image-forming device in the prior art.
Figure 2:
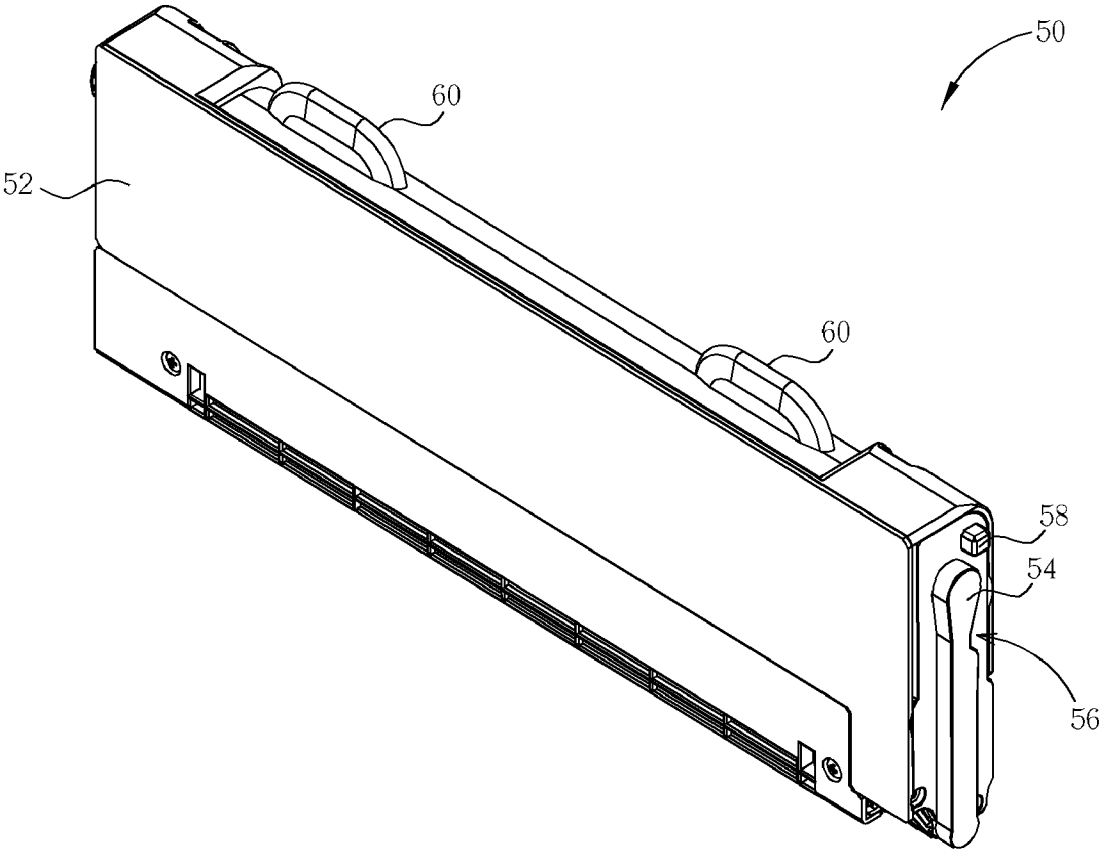
FIG. 2 is a schematic drawing of a developing apparatus according to a preferred embodiment of the present invention.

Please refer to FIG. 2. FIG. 2 is a schematic drawing of a developing apparatus 50 according to a preferred embodiment of the present invention. The developing apparatus 50 can be a flat toner cartridge and installed inside an image-forming device, such as a laser printing device. The developing apparatus 50 includes a housing 52 for covering inner components and containing developer, such as toners. A track 54 is disposed on a lateral side of the developing apparatus 50. The track 54 can be disposed on a single lateral side or both lateral sides of the developing apparatus 50. A notch 56 is formed on the track 54. The notch 56 can be a wedge-shaped notch, an arc-shaped notch, or a notch of other shape. A first identification structure 58 is formed on a lateral side of the developing apparatus 50. The first identification structure 58 can be a protrusion and can be an identification key for identifying a color or a type of the developing apparatus. The first identification structure 58 can be disposed on any position of the developing apparatus 50. At least one handle 60 is disposed on a lateral side of the developing apparatus 50. A user can draw the developing apparatus 50 with the handle 60.

Figure 3:
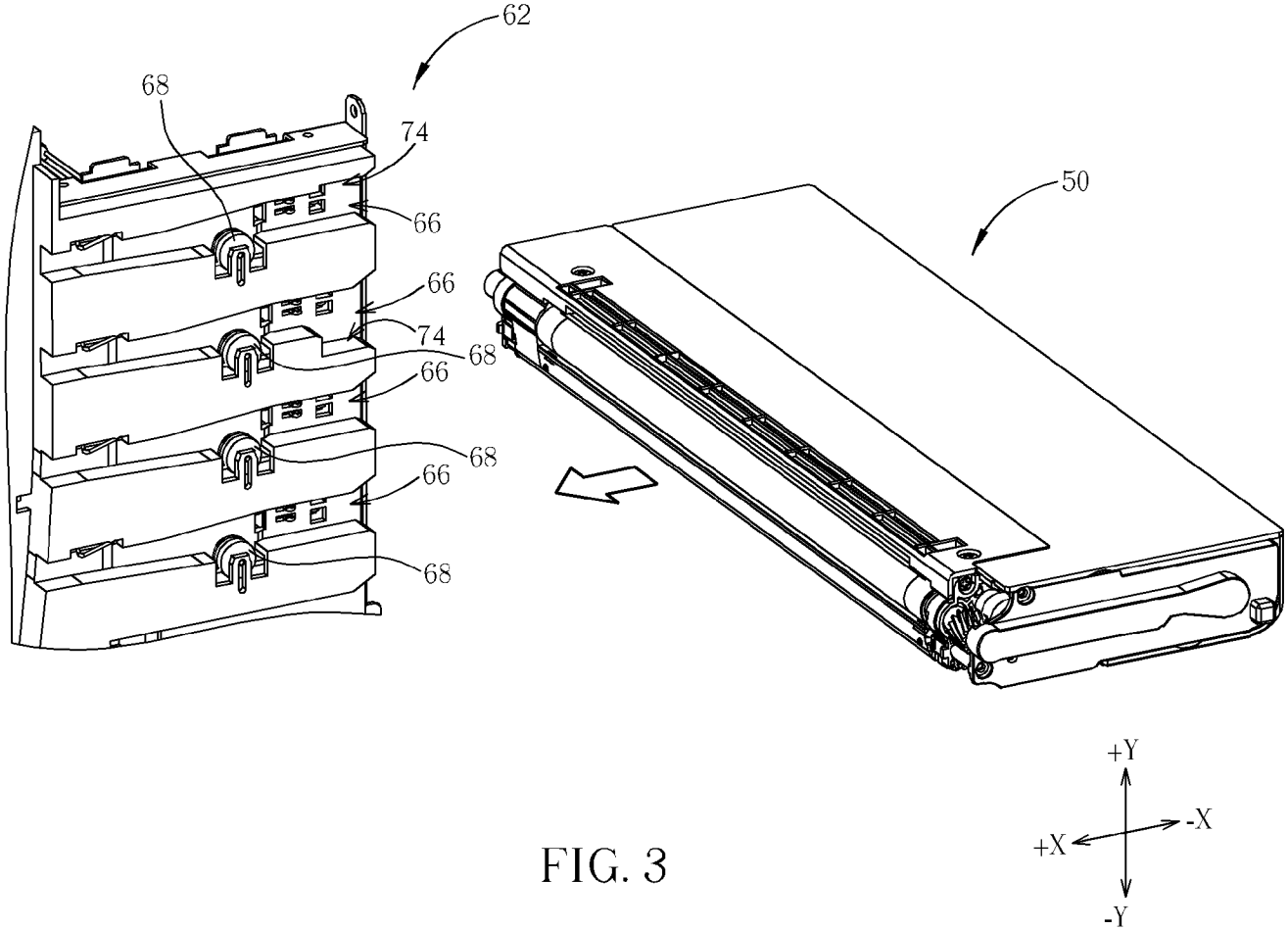
FIG. 3 is a schematic drawing of the developing apparatus inserting into a base according to the preferred embodiment of the present invention.
Figure 4:
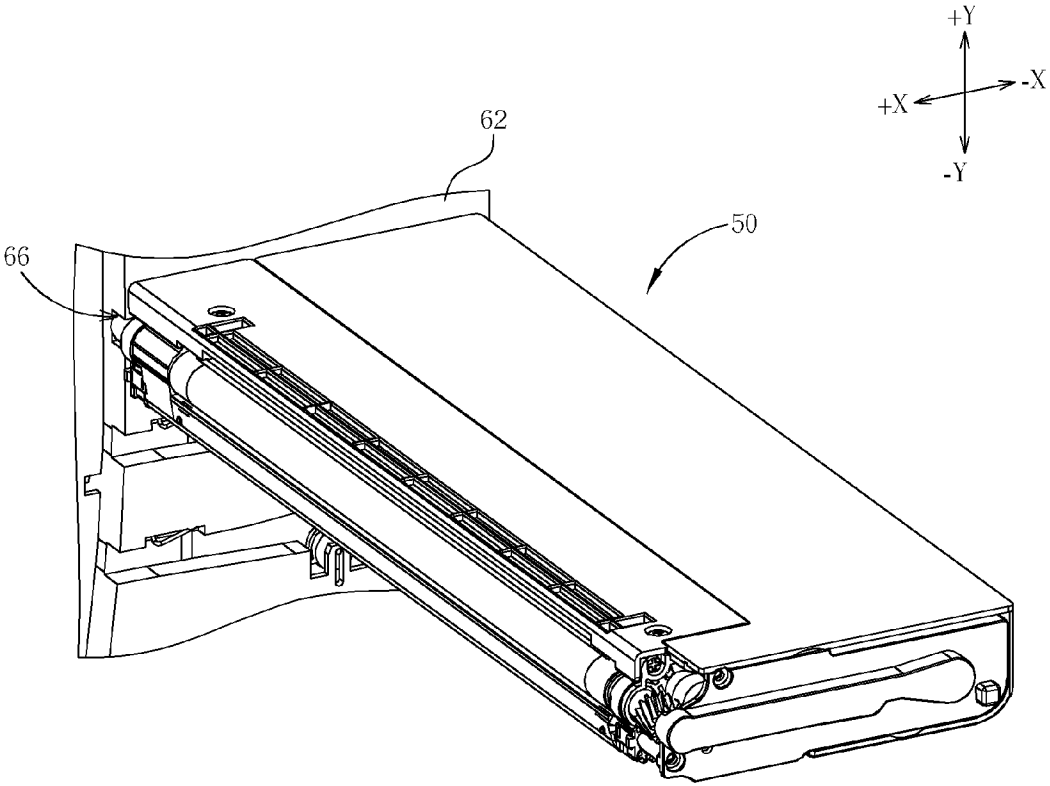
FIG. 4 is a schematic drawing of the developing apparatus inserted into the base completely according to the preferred embodiment of the present invention.
Figure 5:
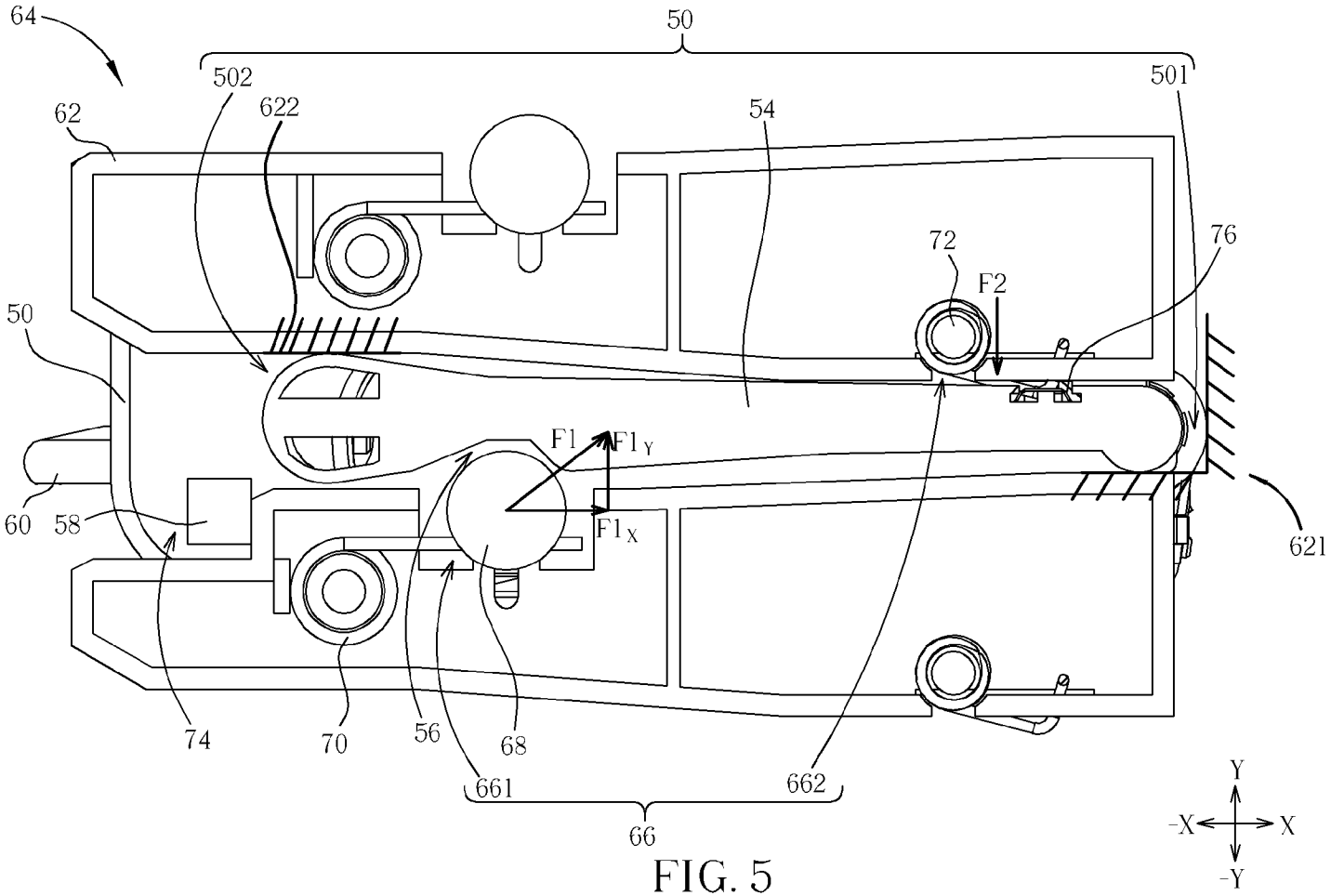
FIG. 5 is a lateral sectional diagram of the developing apparatus combining with the base according to the preferred embodiment of the present invention.

Please refer to FIG. 3 to FIG. 5. FIG. 3 is a schematic drawing of the developing apparatus 50 inserting into a base 62 according to the preferred embodiment of the present invention. FIG. 4 is a schematic drawing of the developing apparatus 50 inserted into the base 62 completely according to the preferred embodiment of the present invention. FIG. 5 is a lateral sectional diagram of the developing apparatus 50 combining with the base 62 according to the preferred embodiment of the present invention. A positioning mechanism 50 for positioning the developing apparatus 50 includes the developing apparatus 50 and the base 62. The base 62 can be a body of an image-forming device, such as a body of a laser printing device. A guide slot 66 is formed on the base 62 for accommodating the developing apparatuses 50 of different colors. The guide slot 66 is for guiding the track 54 of the developing apparatus 50 to slide into the base 62 in +X direction. The positioning mechanism 64 further includes a positioning roller 68, a first elastic component 70, and a second elastic component 72. The positioning roller 68 is disposed on a first side 661 of the guide slot 66. The first elastic component 70 is connected to the positioning roller 68 for providing elastic force to the positioning roller 68 so that the positioning roller 68 presses the developing apparatus 50. The first elastic component 70 can be a spring. The second elastic component 72 is installed on the base 62 and disposed on a second side 662 of the base 62 for providing elastic force to the developing apparatus 50. A second identification structure 74 is formed on the base 62 and disposed in a position corresponding to the first identification structure 58 of the developing apparatus 50. The second identification structure 74 can be a slot for identifying the first identification structure 58 by interference. When the developing apparatus 50 is inserted into the corresponding guide slot 66 correctly, the first identification structure 58 can match the second identification structure 74, that is, the protrusion can slide into the slot without interference. When the developing apparatus 50 is not inserted into the corresponding guide slot 66 correctly, the first identification structure 58 can not match the second identification structure 74, that is, the protrusion can not slide into the slot due to interference. The disposition of the first identification structure 58 and the second identification structure 74 can reduce a risk of installing the developing apparatuses of different colors or types incorrectly. The first identification structure 58 can be disposed on an upper part of a left side, a bottom part of the left side, an upper part of a right side, or a bottom part of the right side of the developing apparatus 50. The second identification structure 74 can be formed as a slot on the base 62 correspondingly to the position of the first identification structure 58 so as to identify the developing apparatuses 50 of four different colors. The number and the disposition of the first identification structure 58 and the second identification structure 74 are not limited to the above-mentioned embodiment and can be arranged according to design demand. In addition, a metal clip 76 is disposed on the track 54 for connecting with an external power terminal so as to receive electricity provided by an external power supply.

When the developing apparatus 50 is inserting into the base 62, the track 54 presses the positioning roller 68 first and slides into the guide slot 66 in +X direction until a first end 501 of the developing apparatus 50 contacts against a first end 621 of the base 62. When the developing apparatus 50 has inserted into the base 62 completely, the track 54 can not press the positioning roller 68 anymore so that the first elastic component 70 provides an elastic restoring force to the positioning roller 68 for driving the positioning roller 68 to wedge in the notch 56 along +Y direction. At this time, the positioning roller 68 presses the track 54 in an oblique direction shown as an arrow in FIG. 5 and applies a force F1 to the track 54. The force F1 can be decomposed into two component forces, $F1_X$ in +X direction and $F1_Y$ in +Y direction wherein +X direction and +Y direction are perpendicular substantially. The component force $F1_X$ makes the first end 501 of the developing apparatus 50 contact against the first end 621 of the base 62 in +X direction tightly. The component force $F1_Y$ makes a second end 502 of the developing apparatus 50 contact against a second end 622 of the base 62 in +Y direction tightly. In addition, the second elastic component 72 applies an elastic force F2 to the track 54 in −Y direction so that the first end 501 of the developing apparatus 50 can contact against the first end 621 of the base 62 in −Y direction tightly. In conclusion, the positioning roller 68 and the second elastic component 72 press the track 54 so that the developing apparatus 50 can contact against the first end 621 of the base 62 in +X and −Y direction tightly and can contact against the second end 622 of the base 62 in +Y direction tightly for positioning the developing apparatus 50 inside the laser printing device accurately.

In contrast to the prior art, the positioning mechanism of the present invention can position the developing apparatus inside the image-forming device accurately, can not increase the size of the laser printing device, and can reduce the number of mechanical components. The present invention provides a positioning mechanism with a simple mechanical design for positioning the developing apparatus in the laser printing device accurately.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A positioning mechanism for positioning a developing apparatus, the positioning mechanism comprising:

a base, a guide slot being formed on the base for guiding the developing apparatus to slide inside the base in a first direction, and the base comprising a first end and a second end; and a positioning roller disposed on a first side of the guide slot for pressing the developing apparatus in a direction different from the first direction when the developing apparatus is inserted inside the base completely so that a first end of the developing apparatus contacts against the first end of the base and a second end of the developing apparatus contacts against the second end of the base, and a first elastic component connected to the positioning roller for providing elastic force to the positioning roller so that the positioning roller presses the developing apparatus.

2. The positioning mechanism of claim 1 wherein a track is formed on the developing apparatus for sliding inside the guide slot of the base.

3. The positioning mechanism of claim 2 wherein a notch is formed on the track and the positioning roller is for inserting in the notch when the developing apparatus is inserted inside the base completely.

4. The positioning mechanism of claim 1 wherein the first end of the developing apparatus contacts against the first end of the base in the first direction and in a second direction substantially perpendicular to the first direction.

5. The positioning mechanism of claim 1 wherein the second end of the developing apparatus contacts against the second end of the base in a second direction substantially perpendicular to the first direction.

6. The positioning mechanism of claim 1 further comprising a second elastic component installed on the base and disposed on a second side of the guide slot for providing elastic force to the developing apparatus in a second direction substantially perpendicular to the first direction so that the first end of the developing apparatus contacts against the first end of the base.

7. The positioning mechanism of claim 1 wherein a first identification structure is formed on the developing apparatus and a second identification structure is formed on the base.

8. The positioning mechanism of claim 7 wherein the first identification structure is a protrusion and the second identification structure is a slot for identifying the first identification structure by interference.

9. The positioning mechanism of claim 7 wherein the first identification structure and the second identification structure are for identifying the developing apparatuses of different colors.

10. The positioning mechanism of claim 7 wherein the first identification structure and the second identification structure are for identifying the developing apparatuses of different types.

11. A developing apparatus for installing inside a base of an image-forming device, a guide slot being formed on the base, the image-forming device comprising a positioning roller for pressing the developing apparatus so that the developing apparatus contacts against the base when the developing apparatus is inserted inside the guide slot of the base completely, the developing apparatus comprising:

a track for sliding inside the guide slot of the base wherein a notch is formed on the track for positioning the positioning roller.

12. The developing apparatus of claim 11 further comprising a metal clip installed on the track.

13. The developing apparatus of claim 11 wherein the notch is an arc-shaped notch.

14. The developing apparatus of claim 11 wherein the notch is a wedge-shaped notch.

15. The developing apparatus of claim 11 wherein an identification structure for identifying a color of the developing apparatus is disposed on the developing apparatus.

16. The developing apparatus of claim 11 wherein an identification structure for identifying a type of the developing apparatus is disposed on the developing apparatus.

17. The developing apparatus of claim 11 wherein a first identification structure is formed on the developing apparatus and a second identification structure is formed on the base.

18. The developing apparatus of claim 17 wherein the first identification structure is a protrusion and the second identification structure is a slot for identifying the first identification structure by interference.

19. The developing apparatus of claim 11 further comprising a handle.

* * * * *